United States Patent [19]

Ikemoto et al.

[11] 4,433,904

[45] Feb. 28, 1984

[54] ELECTROPHOTOGRAPHIC COPYING MACHINE

[75] Inventors: Isao Ikemoto; Junichi Koiso; Akihiko Tamura; Tsugio Hirabayashi, all of Hachioji, Japan

[73] Assignee: Konishiroku Photo Industry Co., Ltd., Tokyo, Japan

[21] Appl. No.: 328,749

[22] Filed: Dec. 8, 1981

[30] Foreign Application Priority Data

Dec. 20, 1980 [JP] Japan ..... 55-179692

[51] Int. Cl.[3] ..... G03G 15/09

[52] U.S. Cl. ..... 355/3 DD; 355/14 D; 355/15; 118/651; 118/652; 118/657; 118/658; 430/122

[58] Field of Search ..... 355/3 DD, 14 D, 15; 118/651, 652, 657, 658; 430/122

[56] References Cited

U.S. PATENT DOCUMENTS

| | | | |
|---|---|---|---|
| 3,983,841 | 10/1976 | Norton | 355/15 X |
| 4,108,546 | 8/1978 | Rezanka | 118/652 X |
| 4,173,405 | 11/1979 | Swapceinski et al. | 355/3 DD |
| 4,213,617 | 7/1980 | Salger | 355/3 DD X |
| 4,323,306 | 4/1982 | Ito et al. | 355/3 DD X |
| 4,324,483 | 4/1982 | Tagawa et al. | 355/3 DD |
| 4,357,097 | 11/1982 | Koiso | 355/15 |
| 4,360,944 | 11/1982 | Iwai et al. | 118/652 X |

*Primary Examiner*—A. C. Prescott

*Attorney, Agent, or Firm*—Frishauf, Holtz, Goodman & Woodward

[57] ABSTRACT

In an electrostatic image reproducing system, the developing unit or cleaning unit comprises a first magnetic brush having a first revolving element which revolves on a first revolving axis, and a plurality of magnets inside the first revolving element. The first revolving element is adjacent to an image recording body and confronts the image recording area of the image recording body. A second magnetic brush unit is axially adjacent to the first magnetic brush unit for attracting and transferring developer, the second magnetic brush unit including a second revolving element having a second revolving axis therein which is substantially colinear with the first revolving axis. The second magnetic brush unit does not confront the image recording area of the image recording body.

12 Claims, 3 Drawing Figures

ELECTROPHOTOGRAPHIC COPYING MACHINE

BACKGROUND OF THE INVENTION

1. Field of the Invention

The present invention relates to a magnetic brush of an electrostatic recording apparatus, particularly, a magnetic brush used for supplying a developer to an image-recording body or for removing a developer from the image-recording body, which has magnets therein and a sleeve that rotates relatively to said magnets on the peripheral surface thereof.

2. Description of the Prior Art

A conventional magnetic brush is used only for developing or for cleaning and therefore, the length of the developing brush nearly corresponds to the width of an image-forming range of the image-recording body.

SUMMARY OF THE INVENTION

The present invention provides a magnetic brush having a portion used for the transportation of the developer, in addition to portions thereof used for developing or cleaning.

The magnetic brush of the present invention is characterized in that magnetic poles are arranged outside of the image-forming area of the image-recording body and are utilized for a purpose other than developing or cleaning, for example the purpose of transporting developers from the developer unit to the cleaning unit, or, from the cleaning unit to the developing unit.

DETAILED DESCRIPTION OF THE PREFERRED EMBODIMENTS

Figure 1:
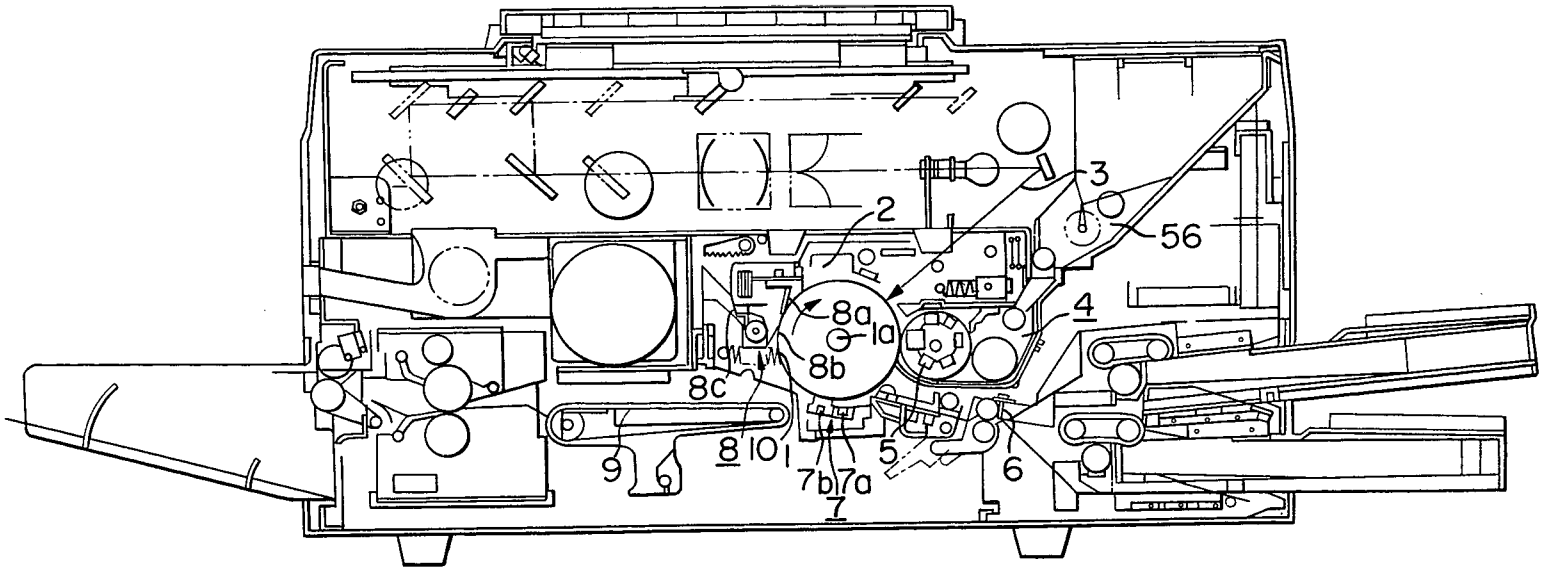
FIG. 1 is a central longitudinal sectional view of an electrophotographic copying machine to which the invention pertains.

In FIG. 1, a photosensitive substance 1 in the shape of a drum rotates in the direction of an arrow together with its shaft 1*a*, its surface is charged by a charging electrode 2 over almost the entire width thereof, its charged surface is image-exposed by an exposure system 3 to form an electrostatic latent image, and a developer is supplied to its charged surface by a magnetic brush 5 of a developing unit 4, which causes the development of the electrostatic latent image. Such developed image is transferred at a transfer unit 7 to a recording paper conveyed by a paper feeding device 6 and the developer remaining on the photosensitive substance 1 is removed by a cleaning unit 8. Numeral 7*a* is a transfer electrode that forms the transfer unit 7, numeral 7*b* is a separation electrode, numeral 9 is a conveying device, for the recording paper to which the developed image is transferred, numeral 10 is a charge eliminating electrode that makes it easy to remove the remaining developer. The illustrated cleaning unit 8 is of the scraper type and numeral 8*a* is a blade, numeral 8*b* is a chute blade for dropping or guiding the scraped developer into the cleaning unit 8 and numeral 8*c* is a screw-conveyer for conveying the developer dropped on the bottom to the recovery conveyance device side. On this electrophotographic copying machine, the magnetic brush relating to the present invention is used as a magnetic brush of the developing unit 4.

Figure 2:
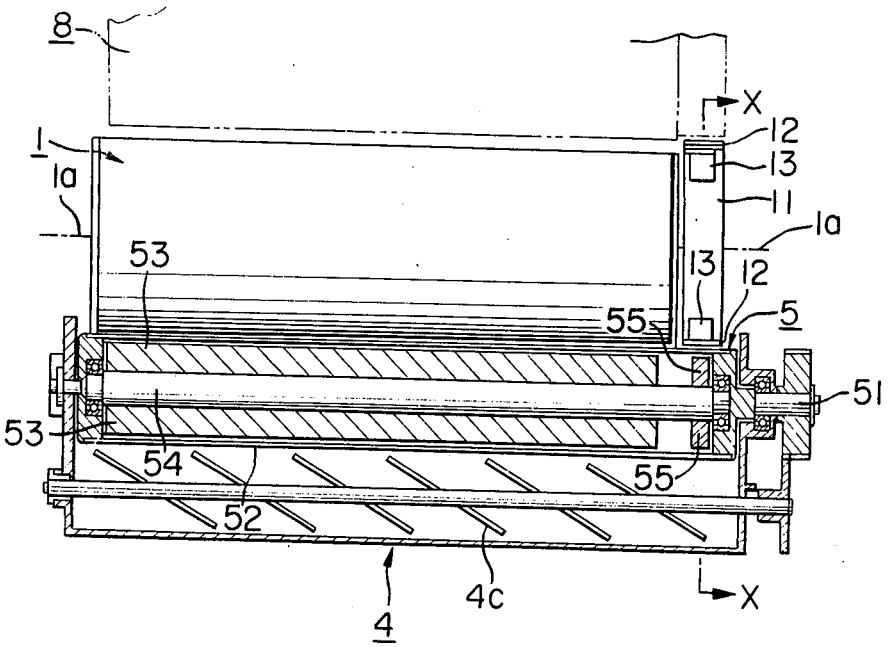
FIG. 2 is a fragmentary top view (partly in section) showing the state wherein a magnetic brush of the present invention is used in a developing unit.
Figure 3:
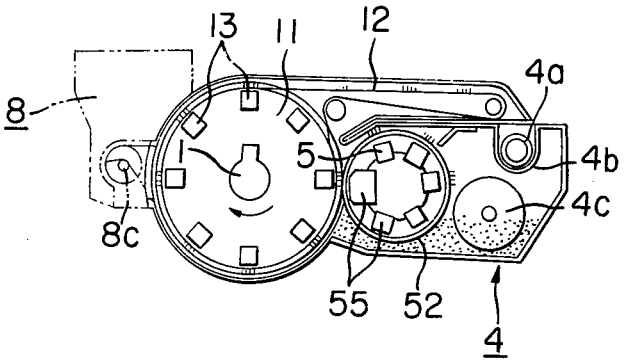
FIG. 3 is a sectional view taken in the direction of the arrows along the line X—X of FIG. 2.

In FIG. 2 and FIG. 3, a revolving sleeve 52 of the magnetic brush 5 that rotates solidly with a shaft 51 rotating in linkage with the rotation of the photosensitive substance 1 has an excessive length extending rightward beyond the width of the photosensitive substance 1 and within such excessive length, magnets 55 are arranged around a fixing shaft 54 in the same manner that magnets 53 are arranged around the fixing shaft 54 inside the revolving sleeve 52 that is related to the development and corresponds to the photosensitive substance 1. To the portion of the revolving sleeve 52 in which magnets 55 are arranged, a magnetic material being mixed in the developer is absorbed or attracted. The magnetic material thus attracted is held by the magnetic force of magnets 13 being pluggingly arranged inside a built-in magnet pulley 11, onto the surface of a conveyer belt 12 that is suspended over the built-in magnet pulley 11 attached to a shaft 1*a* of the photosensitive substance 1 and that is driven in the direction of the arrow shown in FIG. 3. Said magnetic material is thus transported to the cleaning unit 8. The built-in magnet pulley 11 and the conveyer belt 12 are composed of a non-magnetic material respectively. On the side of the cleaning device 8, the developer having been recovered and brought thereto by means of the screw-conveyer 8*c* is adhered to the ears of the magnetic material which are absorbed or attracted on the surface of the conveyer belt 12 and are then brought forward with the movement of the conveyer belt 12. That is to say, the conveyer belt 12 transports the magnetic material which has been adhered on the side of developing unit 4 together with the recovered developer which has been adhered on the side of the cleaning unit 8 and then moves again to the upper part of the developing unit 4. Prior to this, the conveyer belt 12 is away from the built-in magnet pulley 11 and therefore the magnetic material and the developer adhered thereto are, at this stage, in the state that they are free from absorption or attraction forces by the magnets 13. In this connection, when the conveyer belt 12 proceeds on its way again to the side of the built-in magnet pulley 11 at the turning point on the upper part of the developing unit 4, the recovered developer and the magnetic material on the conveyor belt 12 will fall onto a screw-conveyer 4*a* of the developing unit 4 and the screw-conveyer 4*a* transports the recovered developer and the magnetic material having fallen thereon to one end of the width of the developing unit 4. Said screw-conveyer 4*a* is provided inside a distributing conduit 4*b* and the distributing conduit 4*b* is arranged with developer drop holes being perforated over the width corresponding to the whole width of the developing unit 4, and therefore, the recovered developer and the magnetic material being conveyed by means of the screw-conveyer 4*a* fall uniformly from the developer drop holes over the whole width of developing unit 4. Distributing conduit 4*b* is also open for the developer from a developer replenishing hopper 56, shown in FIG. 1, so as to receive them. Therefore, the screw-conveyer 4*a* conveys also the developer from the replenishing hopper 56 together from halfway, and numeral 4*c* indicates an agitating blade by which the developer in the developing unit 4 is uniformly agitated.

In the above embodiment, although there has been referred to the binary component type developer comprising toner and magnetic carrier, the present invention can also be applied to a single component type developer principally comprising magnetic toner. In the present invention, the magnetic poles provided outside the image forming area of the magnetic brush for developing or cleaning may be of the bar-type or cylindrical-type permanent magnets or of the electrically energized type of electromagnets. Further, said magnetic poles may be provided integrally with a magnetic brush for developing or cleaning as an extension of said brush, or may be provided in a separate body.

The present invention has the advantages that the developer transportation device and the closed mechanism can be simplified and there results no problems such as scattering or leakage of developer in the transportation process.

What is claimed is:

1. In an electrostatic image reproducing system including an image recording body having an image recording area thereon, a developing unit arranged adjacent to said image recording body to develop a latent image formed on said image recording body by developer containing a magnetic material, and a cleaning unit arranged adjacent to said image recording body to clean developer off of said image recording body, the improvement wherein one of said developing unit and said cleaning unit comprises:

a first magnetic brush unit including a first revolving element having a first revolving axis therein and having a plurality of magnets inside said first revolving element, said first revolving element being adjacent to said image recording body and confronting said image recording area of said image recording body; and a second magnetic brush unit axially adjacent to said first magnetic brush unit for attracting and transferring developer, including a second revolving element having a second revolving axis therein which is substantially colinear with said first revolving axis, said second magnetic brush unit being arranged so as to be adjacent to but not confronting said image recording area of said image recording body.

2. The electrostatic image reproducing system according to claim 1, further comprising a movable conveyer arranged adjacent said second magnetic brush unit for receiving developer from said second magnetic brush unit and for conveying said receiving developer away from said second magnetic bruch unit.

3. The electrostatic image reproducing system according to claim 2, wherein said moveable conveyor comprises a conveyor belt.

4. The electrostatic image reproducing system according to claim 3, wherein said image recording body is a generally cylindrical body, said conveyor belt being engaged around a peripheral portion of said image recording body.

5. The electrostatic image reproducing system according to claim 1, wherein said first and second revolving elements comprise a revolving sleeve.

6. The electrostatic image reproducing system according to claim 5, wherein said first and second revolving elements comprise a common revolving sleeve.

7. The electrostatic image reproducing system according to claim 6, wherein said second magnetic brush unit comprises magnets independent of said magnets of said first magnetic brush unit, located within an end portion of said common sleeve which does not confront said image recording area of said image recording body.

8. The electrostatic image reproducing system according to claim 7, further comprising a movable conveyor arranged adjacent said second magnetic brush unit for receiving developer from said second magnetic brush unit and for conveying said receiving developer away from said second magnetic brush unit.

9. The electrostatic image reproducing system according to claim 8, wherein said image recording body is a generally cylindrical body, and wherein said conveyor is engaged around a peripheral portion of said image recording body.

10. The electrostatic image reproducing system according to claim 5, wherein said image recording body is a generally cylindrical body arranged adjacent said first and second revolving elements.

11. The electrostatic image reproducing system according to claim 6, wherein said image recording body is a generally cylindrical body arranged adjacent said common revolving sleeve.

12. The electrostatic image reproducing system according to claim 7, wherein said image recording body is a generally cylindrical body arranged adjacent said common revolving sleeve.

* * * * *